US008506289B2

(12) United States Patent
McGuigan et al.

(10) Patent No.: US 8,506,289 B2
(45) Date of Patent: Aug. 13, 2013

(54) CANDLE HOLDER WITH HEAT DEFLECTING SHIELD

(75) Inventors: Charles C. McGuigan, Alpharetta, GA (US); Thomas E. Mazurek, Dublin, OH (US); Heather M. Mastny, Dublin, OH (US)

(73) Assignee: Bath & Body Works Brand Management, Inc., Reynoldsburg, OH (US)

( * ) Notice: Subject to any disclaimer, the term of this patent is extended or adjusted under 35 U.S.C. 154(b) by 1396 days.

(21) Appl. No.: 12/218,609

(22) Filed: Jul. 15, 2008

(65) Prior Publication Data

US 2010/0015561 A1 Jan. 21, 2010

(51) Int. Cl.
*F21V 35/00* (2006.01)
*F23D 3/16* (2006.01)

(52) U.S. Cl.
USPC ..... 431/291; 431/288

(58) Field of Classification Search
USPC ..... 431/288–291; D26/6–23
See application file for complete search history.

(56) References Cited

U.S. PATENT DOCUMENTS 2,072,692 A * 3/1937 Valle ..... 362/161
2,080,251 A 5/1937 Buskard
2,240,071 A 4/1941 Gisolfi
2,246,346 A 6/1941 Carroll
2,812,653 A 11/1957 Meunier
3,244,872 A * 4/1966 McCormick ..... 40/540
3,737,287 A * 6/1973 Churchill et al. ..... 422/120
5,683,239 A * 11/1997 Cardosi ..... 431/291
5,688,040 A * 11/1997 Klees ..... 362/163
5,803,587 A * 9/1998 Chen ..... 362/161
6,030,093 A * 2/2000 Draper ..... 362/161
6,231,336 B1 5/2001 Chen
6,382,962 B1 5/2002 Papai
6,439,223 B1 * 8/2002 Draper et al. ..... 126/258
D465,587 S 11/2002 Papai
6,555,188 B1 * 4/2003 Chapman ..... 428/17

(Continued)

FOREIGN PATENT DOCUMENTS

DE 3302591 A1 * 8/1984

OTHER PUBLICATIONS

STIC Search.pdf.*

(Continued)

*Primary Examiner* — Steven B McAllister
*Assistant Examiner* — Frances H Kamps
(74) *Attorney, Agent, or Firm* — Andrus, Sceales, Starke & Sawall, LLP

(57) ABSTRACT

A candle holder apparatus for housing a candle and a method for using such a device, the candle holder apparatus comprising a body having an open top, at least one body wall, and a cavity configured to house a candle. The candle holder further comprises a heat deflecting shield and a cover having a recess configured to house the heat deflecting shield. The heat deflecting shield is seated in the cover recess such that an air gap is formed between the heat deflecting shield and an inner surface of the cover. This air gap insulates and decreases the top surface temperatures of the cover, allowing a user to touch the cover without being burned. Further, the candle holder cover is configured to fit on the open top of the candle holder body. Vent openings are disposed in the wall of the candle holder body to permit airflow between the cavity and the exterior when the cover is atop the body.

18 Claims, 5 Drawing Sheets

U.S. PATENT DOCUMENTS

| | | | | |
|---|---|---|---|---|
| 6,585,510 | B2 | 7/2003 | Papai | |
| 6,589,047 | B1 | 7/2003 | Papai | |
| 6,663,384 | B2 * | 12/2003 | Papai | 431/289 |
| 6,705,741 | B2 * | 3/2004 | Bonnema et al. | 362/186 |
| 6,783,356 | B2 * | 8/2004 | Hermanson | 431/126 |
| D503,003 | S | 3/2005 | Nelson et al. | |
| 7,044,320 | B2 | 5/2006 | Mladenovic | |
| 7,219,663 | B2 * | 5/2007 | Cuomo | 126/25 R |
| 7,249,947 | B2 | 7/2007 | Papai | |
| 7,314,287 | B2 * | 1/2008 | Fan | 362/183 |
| 7,564,010 | B2 * | 7/2009 | Moon | 219/621 |
| 2004/0125598 | A1 * | 7/2004 | Bryce | 362/161 |
| 2004/0241603 | A1 | 12/2004 | Papai | |
| 2005/0079466 | A1 * | 4/2005 | Thune et al. | 431/291 |
| 2005/0277076 | A1 | 12/2005 | Papai | |
| 2005/0277078 | A1 | 12/2005 | Papai | |
| 2006/0123694 | A1 * | 6/2006 | Welch | 43/113 |
| 2008/0083150 | A1 * | 4/2008 | Palozzi | 43/1 |
| 2008/0318177 | A1 * | 12/2008 | Requejo et al. | 431/291 |
| 2009/0004614 | A1 * | 1/2009 | Furner et al. | 431/291 |
| 2009/0065499 | A1 * | 3/2009 | England | 219/621 |

OTHER PUBLICATIONS

U.S. Consumer Product Safety Commission "Pumpkin Candle Holders Sold by QVC Recalled Due to Laceration Hazard" Office of Information and Public Affairs, 1-3 (Jan. 2007).

* cited by examiner

CANDLE HOLDER WITH HEAT DEFLECTING SHIELD

FIELD OF THE INVENTION

The present invention relates to candle housing devices, and more particularly, to a heat shield for deflecting heat in a candle holder device.

BACKGROUND OF THE INVENTION

Although electric lighting has surpassed candle lighting, candles are still utilized as decorative items during holidays, special occasions, or in homes, churches, or other locations. Candle holders are used to enhance candle appearance and to create special lighting effects. Generally, candle holders comprise a cup-like container with an open top for receiving a candle and are made of various materials, shapes, and colors.

Candle holders may also be enclosed, without the open top. The problems with the enclosed candle holders are that if the covers are closed on the candle holders for an extended period of time, it can lead to overheating of the candle and the candle holder, or extinguishing the flame due to inefficiency of combustion.

To improve enclosed candle holders, the candle industry had begun developing various devices and accessories. For example, heat deflectors or candle bases deflect heat from the candle holder's surface and protect other surfaces from overheating. Also, candle protective covers have become widely used in the art in order to prevent hazardous situations from occurring due to the open flame of a candle.

Various systems exist in the field utilizing venting plates, chassis, or other devices and accessories to help solve the aforementioned problems. For example, protective covers with a central exhaust vent, adapted to fit over the mouth of the candle holder, are known in the art. Those types of covers protect the candle flame from being extinguished and the candle holder from overheating. The central exhaust vent also permits necessary ventilating airflow to reach the flame from outside of the candle holder. As such, the candle burns longer and a minimum amount of heat is produced while burning. These protective covers may further comprise vent openings surrounding the central exhaust vent. The vent openings create airflow within the jar and help stabilize the flame, improve combustion, and reduce smoke and turbulence within the candle holder. These accessories, however, can be hazardous as exterior objects can fall into the central exhaust vent and catch fire. In addition, these accessories may not be aesthetically pleasing.

Other candle holder systems known to the art include candle holders with venting plates or chassis conforming to the shape of the mouth of the candle to circulate air within the candle holder and control the temperature within. Many of these venting plates or chassis contain central exhaust vents and baffles. Such vents or chassis direct airflow into the interior of the candle container through the vent and down the sidewall, separating the downward flow and the upward flow. These devices provide thermal insulation to protect the candle holder from overheating and provide sufficient airflow, thus improving combustion and reducing smoke. In addition, these venting plates or chassis may further comprise vent openings surrounding the central exhaust vent. The vent openings can help increase the velocity and inertia of airflow and vent the airflow directly onto the sidewalls. However, these devices may also be hazardous and may not be aesthetically pleasing.

Accordingly, there exists a need for a candle holder with a decorative appearance and configuration such that the candle wick stays lit and undergoes efficient combustion in a closed-top environment. In addition, there exists a need for a candle holder configuration that efficiently prevents a candle holder from overheating while remaining in a closed-top environment.

SUMMARY OF THE INVENTION

One object of the present invention is to provide a candle holder in which the candle wick stays lit and undergoes efficient combustion while remaining in a closed-top environment.

Another object of the present invention is to provide a candle holder in which the candle wick stays lit and undergoes efficient combustion while maintaining a decorative appearance.

It is also an object of the present invention to provide a candle holder that efficiently prevents a candle from overheating while remaining in a closed-top environment.

It is another object of the present invention to provide a candle holder that permits the circulation of air in a closed-top environment.

It is also an object of the present invention to provide a candle holder where the temperature of the inner cavity of the candle holder is maintained at or below 180 degrees F.

It is also an object of the present invention to provide a candle holder where the temperature of the candle holder cover is maintained at or below 180 degrees F. so the user can touch the candle holder cover without being burned.

It is also an object of the present invention to provide a candle holder where smoke and turbulence are reduced while remaining in a closed-top environment.

According to one embodiment, the present invention comprises a candle holder apparatus for housing a candle. The candle holder apparatus comprises a body having an open top, at least one body wall, and a cavity configured to house a candle. The candle holder further comprises a heat deflecting shield and a cover having a recess configured to house the heat deflecting shield. The candle holder cover is configured to fit on the open top of the candle holder body. Vent openings are disposed in the wall of the candle holder body to permit airflow between the cavity and the exterior when the cover is atop the body.

According to a method of use of the present invention, a candle is placed in the candle holder body having an open top, at least one body wall, and a cavity configured to house the candle. A heat deflecting shield is inserted into a recess in the candle holder cover such that an air gap is formed between the heat deflecting shield and an inner surface of the cover. The air gap insulates and decreases top surface temperatures of the cover. The cover is then attached to the candle holder body. Vent openings are disposed in the wall of the body to allow airflow between the cavity and the exterior. The heat deflecting shield deflects the heat and air inside the cavity outwards towards the vent openings in the wall of the body and insulates the cover.

BRIEF DESCRIPTION OF THE DRAWINGS

A further understanding of the present invention can be obtained by reference to a preferred embodiment, along with some alternative embodiments, set forth in the illustrations of the accompanying drawings. Although the illustrated embodiments are merely exemplary of systems for carrying out the present invention, the organization and method of operation of the invention in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following figures.

DETAILED DESCRIPTION OF THE INVENTION

Illustrative embodiments of the present invention are disclosed herein. However, techniques, systems and operating structures in accordance with the present invention may be embodied in a wide variety of forms and modes, some of which may be different from those in the disclosed embodiment. Consequently, the specific functional details disclosed herein are merely representative, yet in that regard, they are deemed to afford the best embodiment for purposes of disclosure and to provide a basis for the claims herein which define the scope of the present invention.

Moreover, well known methods and procedures for both carrying out the objectives of the present invention and illustrating the preferred embodiment are incorporated herein but have not been described in detail as not to unnecessarily obscure novel aspects of the present invention.

Figure 2:
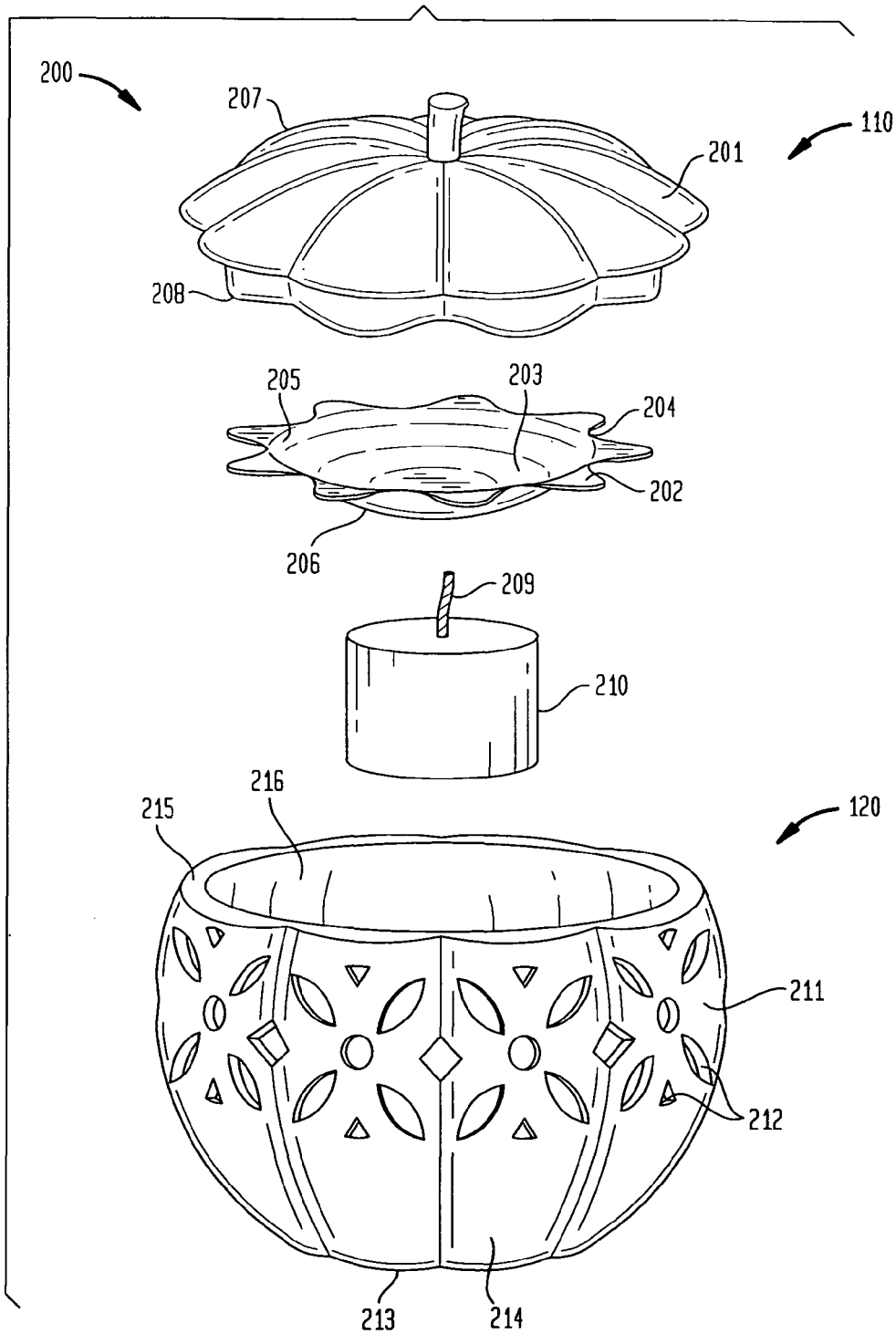
FIG. 2 is an exploded view of the candle holder apparatus shown in FIG. 1 according to an embodiment of the present invention.

Referring now to FIG. 2, an exploded view of candle holder apparatus 200 according to an embodiment of the present invention is shown. As shown in FIG. 2, candle apparatus 200 comprises candle holder cover 110 and candle holder 120. Candle holder cover 110 generally includes body 201 comprising upper surface 207 and bottom surface 208. Candle holder cover assembly 110 also comprises heat deflecting shield 203. Heat deflecting shield 203 generally includes semi-spherical body 205 comprising outer surface 206, inner surface 204, and edges 202. Heat deflecting shield 203 is inserted into bottom surface 208 of candle holder cover 110 to insulate cover 110 from heat emitted from candle 210. In one embodiment, candle holder cover body 201 is dome shaped in order to receive similarly dome shaped heat deflecting shield 203. However, any shaped candle holder body may be used for these objects. For example, candle holder cover 110 may be square, flat, triangular, or the like.

Candle holder 120 has open top body 211 comprising wall 214, ledge 215, and base 213. Candle holder body 211 further comprises cavity 216 configured to receive candle 210. Specifically, wall 214 is configured to form cavity 216 about base 213. In one embodiment, cavity 216 is formed by casting one round continuous wall 214 about base 213. However, any shape and number of walls 214 may be used to form cavity 216. For example, multiple walls 214 may be used to form cavity 216 about base 213 if body 211 comprises a square shape. Wall 214 may be any height, provided that it extends above wick 209 of candle 210 so that cover 110 (including heat deflecting shield 203) does not obstruct the flame of candle 210. In addition, the width of cavity 216 may be any width, wider than the body of candle 210. According to one embodiment of the present invention, base 213 and wall 214 are casted together to form one candle holder body 211. In this embodiment, candle holder cover 110 is separate from candle holder body 120 and is configured to fit on top of cavity 216. However, candle holder cover 110 may be casted together with candle holder body 120 as further described in FIG. 7.

Wall 214 may comprise vent openings 212 disposed near the top of candle holder body 211. Vent openings 212 are provided to permit airflow between cavity 216 of body 211 and the exterior. Vent openings 212 are disposed near the top of candle holder body 211 in order to allow air to escape cavity 216 of body 211. In one useful embodiment, many small vent openings 212 are disposed at wall 214 in a decorative pattern as shown in the figure. In other useful embodiments, any pattern of vent openings 212 may be used without departing from the scope of the invention. Preferably, vent openings 212 are small enough that a user cannot place foreign objects through vent openings 212 into body 211 of candle holder apparatus 100. Also, vent openings 212 should be small enough that a user cannot fit his or her finger through vent openings 212 and get burned. In this embodiment, the vents have openings less than ½ inch.

Figure 1:
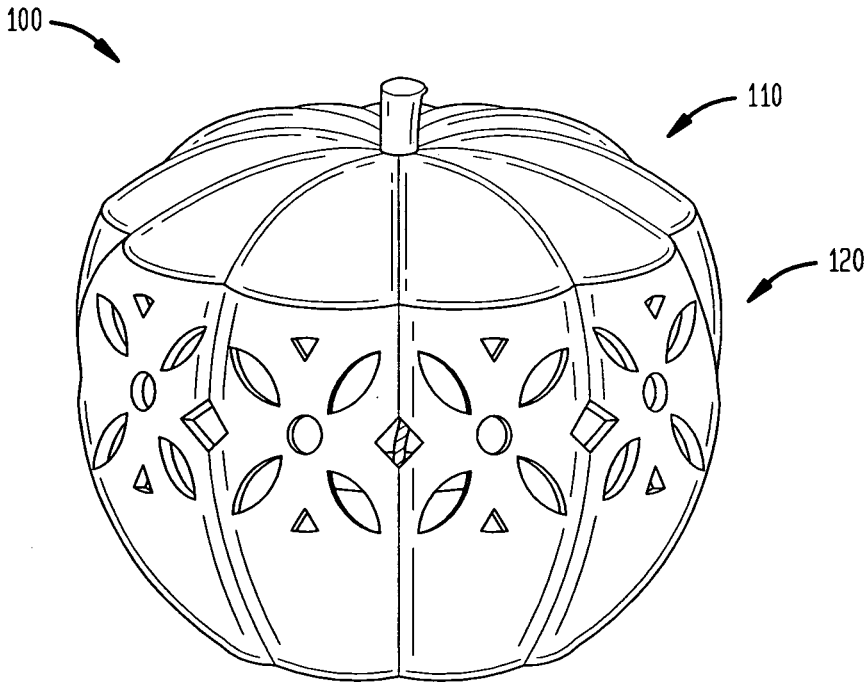
FIG. 1 is a closed front elevation view of the candle holder apparatus according to an embodiment of the present invention.

Referring now to FIG. 1, a closed front elevation view of candle holder apparatus 100 according to an embodiment of the present invention is shown. Candle holder cover assembly 110 is shaped and sized to fit securely on candle holder body 120, by means discussed in FIG. 6. Specifically, when candle holder cover 110 is atop candle holder body 120, the two together appear as a single unit. Although a round shaped candle holder apparatus 100 is illustrated, any shaped candle holder may be provided without departing from the scope of the present invention. For example, candle holder apparatus 100 may comprise a square shape, a rectangle shape, a triangle shape, or the like. Candle holder apparatus 100 may also comprise any simulative shape, such as a pumpkin, an apple, or a Christmas tree. Beneficially, the configuration of the present invention allows for any closed shape to be formed. As such, the apparatus of the present invention provides a decorative appearance while remaining safe to use as will be apparent in reference to FIG. 6.

Figure 3:
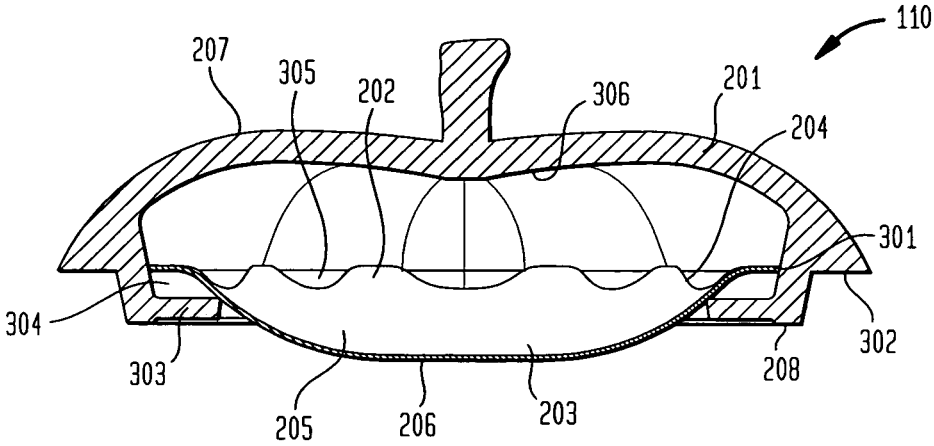
FIG. 3 is a cross-sectional view of the candle holder cover according to an embodiment of the present invention.

Referring now to FIG. 3, a cross-sectional view of candle holder cover 110 according to an embodiment of the present invention is shown. Candle holder cover 110 generally comprises body 201 including upper surface 207, bottom surface 208, and recess 306. Seat 302 extends laterally from upper surface 207, while inner lip 303 extends downward from seat 302 and then laterally over rim 301 of recess 306. Alcove 304 is formed between inner lip 303 and recess 306. Heat deflecting shield 203 is inserted into recess 306 to insulate upper surface 207 of cover 110 from the heat of the candle and keep temperatures below or at 180 degrees F. Candle holder inner lip 303 is provided to hold edges 202 of heat deflecting shield 203 in alcove 304 so that heat deflecting shield 203 can only be removed by force while still having leeway to move within recess 306. In one embodiment, inner lip 303 may be continuous around rim 301 of cover recess 306. However, inner lip 303 may also be provided intermittently around rim 301 of recess 306 to hold edges 202 of heat deflecting shield 203 in place in recess 306. Cover body 201 may comprise ceramic or glassware material. Preferably, cover body 201 comprises material that has a low thermal conductivity, or otherwise resists the transfer of heat from the contact points of heat deflecting shield 203 to cover body 201.

Figure 4:
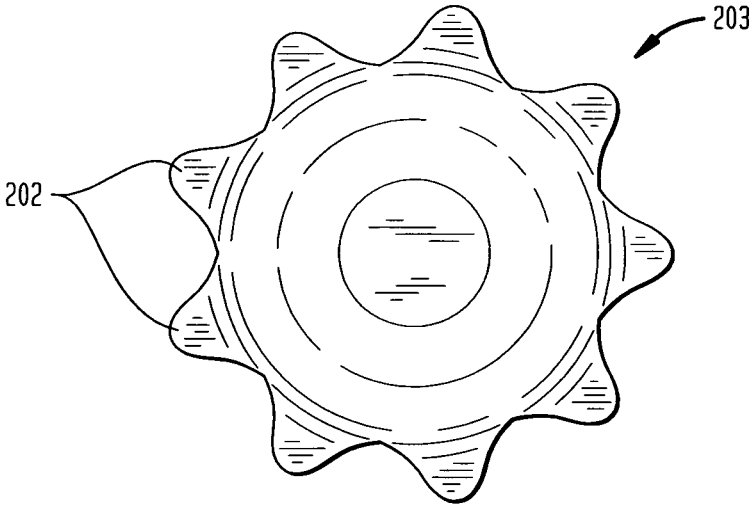
FIG. 4 is a top view of the heat deflecting shield according to an embodiment of the present invention.
Figure 5:
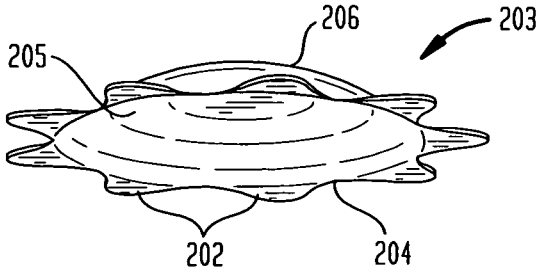
FIG. 5 is a perspective view of the heat deflecting shield according to an embodiment of the present invention.

Referring now to FIGS. 4 and 5, a top view of heat deflecting shield 203 (FIG. 4) and a perspective view of heat deflecting shield 203 (FIG. 5) according to an embodiment of the present invention are shown. Outer surface 206 of heat deflecting shield 203 is preferably dome shaped to permit the heat from candle 210 to spread outward through vent openings 212 in wall 214 rather than directly back into the burn pool of candle 210, as later described in FIG. 6. However, any shape may be used for heat deflecting shield 203 that would allow the heat from the candle flame to be deflected to the sides of the candle holder apparatus 100. Edges 202 are located on the periphery of heat deflecting shield 203. Edges 202 of heat deflecting shield 203 are shown to be curved, however, any shape may be utilized for edges 202 without departing from the scope of the invention. For example, edges 202 may include, but not limited to square edges, rectangular edges, or the like. In another embodiment, heat deflecting shield 203 may comprise one continuous edge around its periphery. Preferably, heat deflecting shield 203 comprises an aluminum material. However, heat deflecting shield 203 may comprise any other lightweight metal or material with a high melting point, capable of deflecting and diffusing heat.

Figure 6:
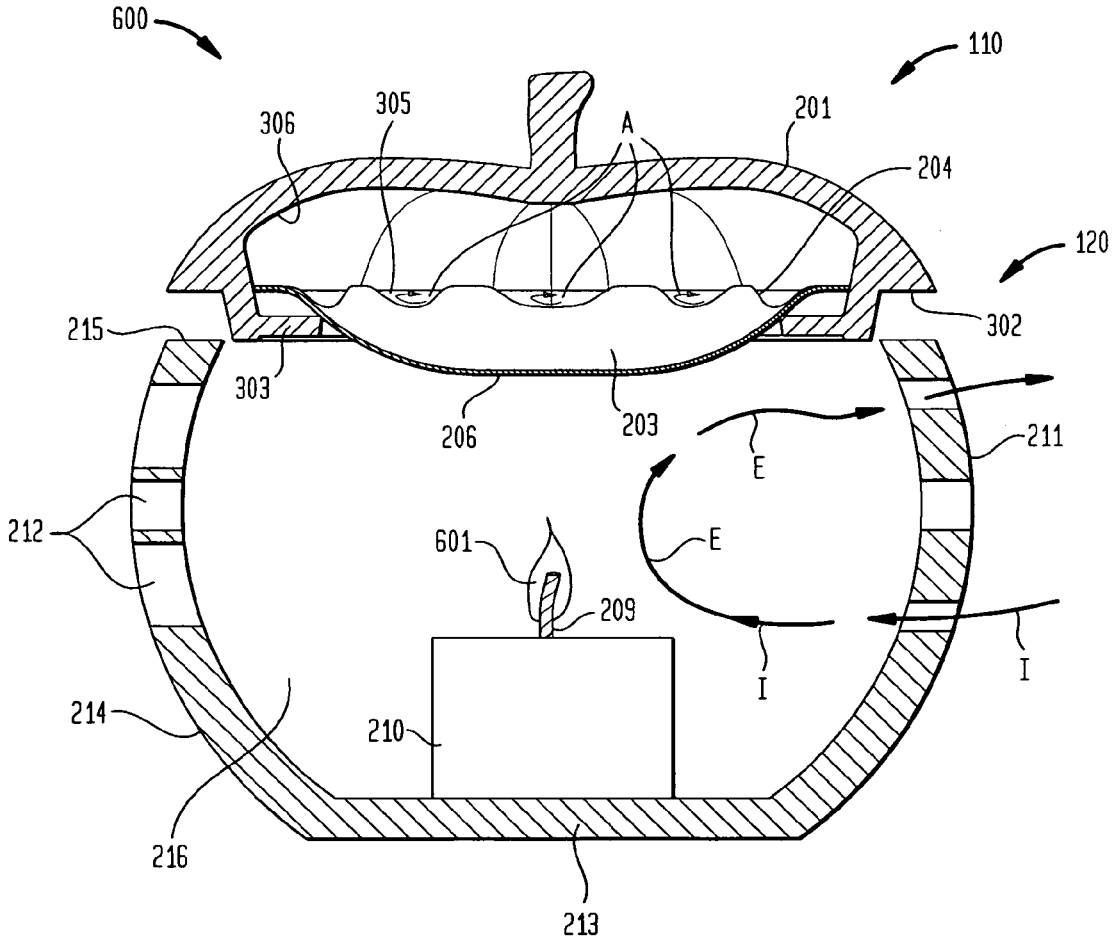
FIG. 6 is a cross-sectional view of the candle holder apparatus according to an embodiment of the present invention.

Referring now to FIG. 6, a cross-sectional view of candle holder apparatus 600 according to one embodiment of the present invention is shown. Candle holder cover 110 fits on the open top of candle holder body 211 by means of seat 302 and ledge 215. Seat 302 of cover body 201 rests on top of ledge 215 of candle holder body 211, making cover 110 and candle holder 120 appear as a single unit. Width of seat 302 is configured to fit securely on top of ledge 215, with inner lip 303 holding seat 302 and ledge 215 together.

In use, candle 210, having candle wick 209, is seated on base 213 in cavity 216. When candle wick 209 of candle 210 is lit, exhaust airflow E rises from flame 601 to heat deflecting shield 203 and then deflects via dome shaped outer surface 206 towards wall 214. Exhaust airflow E then exits out of candle holder 120 via vent openings 212 to the exterior. Rising hot exhaust airflow E creates a negative air pressure inside body 211 that draws cool inlet airflow I into cavity 216 of body 211. Venting of exhaust airflow E and inlet airflow I helps to improve combustion and avoid extinguishing the candle flame 601 as the heat is deflected outwards toward the exterior as opposed to back towards the candle wick 209. The temperature is maintained at or below 180 degrees F. as the heat is allowed to exit candle holder body 211 via vent openings 212. This helps to prevent closed candle holder apparatus 100 from overheating and potentially cracking or exploding. This configuration also helps to reduce smoke and turbulence as well as stabilize the flame 601 as the heated air is not blown directly back into the burn pool of candle 210.

Further, there exists an air gap 305 between recess 306 of cover body 201 and heat deflecting shield 203. The dome shaped heat deflecting shield 203 will allow air A to circulate in air gap 305, between cover body 201 and inner surface 204 of heat deflecting shield 203. The circulating air A will insulate and decrease top surface temperatures of cover 110 to at or below 180 degrees F. This enables a user to remove cover 110 from candle holder body 120 without being burned.

Figure 7:
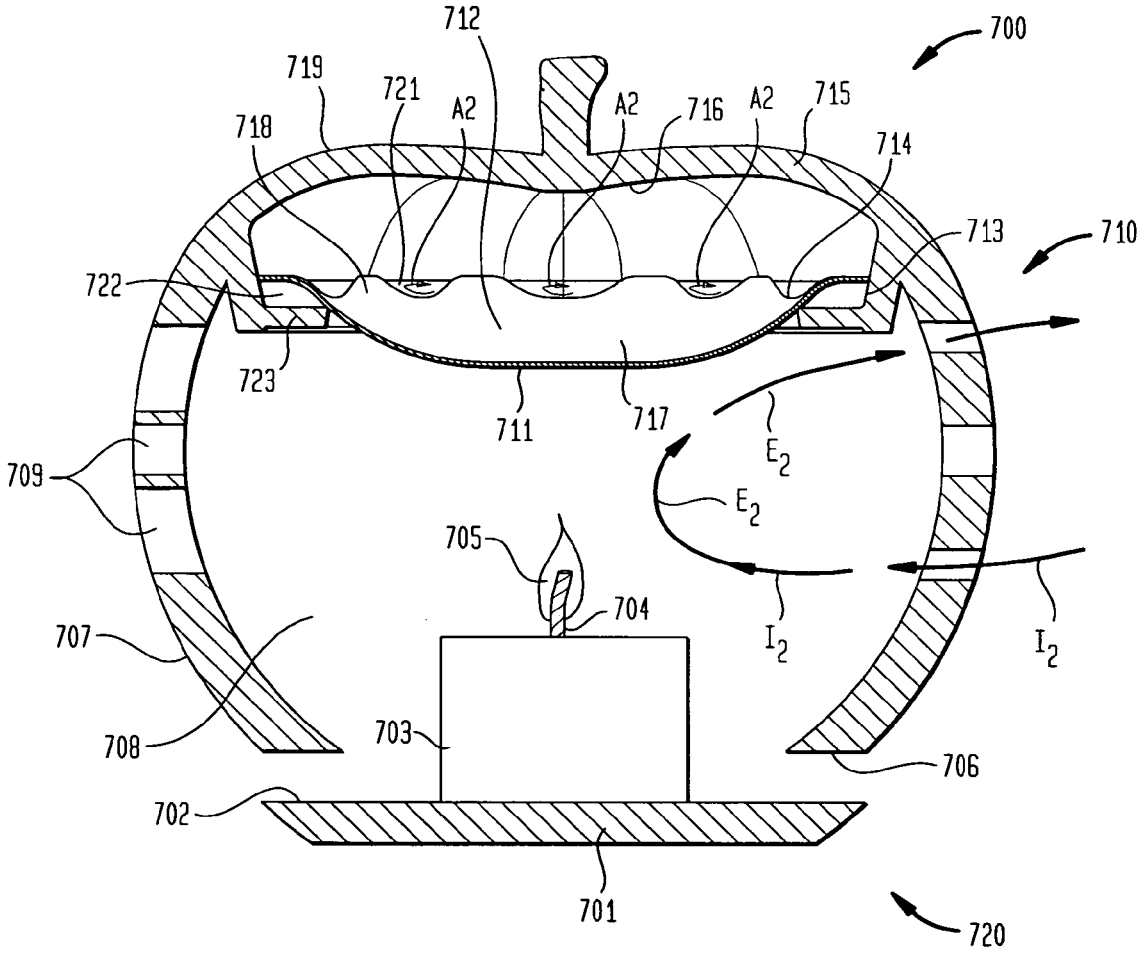
FIG. 7 is a cross-sectional view of the candle holder apparatus according to an alternative embodiment of the present invention.

Referring now to FIG. 7, a cross-sectional view of an alternative embodiment of candle holder apparatus 700 according to the present invention is shown. Candle holder apparatus 700 generally comprises single casted cover 710 and base 720. Candle holder cover 710 comprises cover body 715 including upper surface 719 and wall 707. Wall 707 ends with seat 706 and forms cavity 708 therebetween. In this embodiment, base 720 acts as a separate piece upon which candle 703 is seated. Seat 706 of cover body 715 rests on top of ledge 702 of base 701, making cover 710 and base 720 appear as a single unit. Wall 707 may comprise vent openings 709 disposed near the top of candle holder cover body 715. Candle holder cover 700 further comprises recess 716 and inner lip 723 extending downward from recess 716 and then laterally over rim 713, forming alcove 722.

Candle holder cover 710 also comprises heat deflecting shield 717. Heat deflecting shield 717 generally includes semi-spherical body 712 comprising outer surface 711, inner surface 714, and edges 718. Heat deflecting shield 717 is inserted into recess 716 forming an air gap 721. Candle holder inner lip 723 is provided to hold edges 718 of heat deflecting shield 717 in alcove 722 so that heat deflecting shield 717 can only be removed by force while still having leeway to move within recess 716.

In use, candle 703 having candle wick 704 is seated on base 701 and is covered by candle holder cover body 715. When candle wick 704 of candle 703 is lit, exhaust airflow E2 rises from flame 705 to heat deflecting shield 717, deflects via dome shaped outer surface 711 towards wall 707, and exits out of candle holder cover 710 via vent openings 709. As rising hot exhaust airflow E2 exits out of vent opening 709, negative air pressure is created inside cavity 708 that draws cool inlet airflow I2 into cavity 708 through vent opening 709. Since the heat is deflected outwards toward the exterior as opposed to back towards the candle wick 704, the temperature inside candle holder apparatus 700 is maintained at or below 180 degrees F. This configuration also helps to reduce smoke and turbulence as well as stabilize flame 705. In addition, the dome shaped heat deflecting shield 717 will allow air A2 to circulate inside air gap 721, between cover body 715 and inner surface 714 of heat deflecting shield 717. The circulating air A2 will insulate and decrease top surface temperatures of cover 710. This enables a user to remove cover 710 from candle holder base 720 without being burned.

While the present invention has been described with reference to the preferred embodiment and alternative embodiments, which have been set forth in considerable detail for the purposes of making a complete disclosure of the invention, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. For example, any element described herein may be provided in any desired size (e.g., any element described herein may be provided in any desired custom size or any element described herein may be provided in any desired size selected from a "family" of sizes, such as small, medium, large). It should be appreciated that the present invention is capable of being embodied in other forms without departing from its essential characteristics.

What is claimed is:

1. A candle holder apparatus for housing a candle comprising:

a body having an open top, at least one body wall forming a cavity configured to house a candle;

a heat deflecting shield;

a cover having a recess configured to house said heat deflecting shield, wherein said cover is configured to fit on the open top of said body, and further wherein said cover comprises an inner lip that extends laterally inwardly from a perimeter of said cover, wherein edges of said heat deflecting shield are held in place inside an alcove in said recess by said inner lip; and at least one vent opening disposed in said at least one body wall of said body to allow airflow between said cavity and the exterior of said body.

2. The candle holder apparatus according to claim 1 wherein said heat deflecting shield is aluminum.

3. The candle holder apparatus according to claim 1 wherein said heat deflecting shield is dome shaped.

4. The candle holder apparatus according to claim 1 wherein said cover and said body are ceramic.

5. The candle holder apparatus according to claim 1 wherein said heat deflecting shield is seated in said recess such that an air cap is fog need between said heat deflecting shield and an inner surface of said cover, wherein said air gap insulates and decreases top surface temperatures of said cover.

6. The candle holder apparatus according to claim 1 wherein said heat deflecting shield directs air from inside said cavity to exit through said at least one vent opening.

7. A candle holder apparatus for housing a candle comprising:

a body having an open top, at least one body wall forming a cavity configured to house a candle;

a dome shaped heat deflecting shield;

a cover having a recess configured to house said dome shaped heat deflecting shield, wherein said cover is configured to fit on the open top of said body; and at least one vent opening disposed in said at least one body wall of said body to allow airflow between said cavity and the exterior of said body, wherein the dome shaped heat deflecting shield extends in a downward direction toward the candle effectuating air circulation in an air gap between the dome shaped heat deflecting shield and the cover, and further effectuates the airflow between said cavity and the exterior of said body.

8. The candle holder apparatus according to claim 7 wherein said dome shaped heat deflecting shield is aluminum.

9. The candle holder apparatus according to claim 7 wherein said dome shaped heat deflecting shield is seated in said recess such that an air gap is formed between said dome shaped heat deflecting shield and an inner surface of said cover, wherein said air gap insulates and decreases top surface temperatures of said cover.

10. The candle holder apparatus according to claim 7 wherein said cover and said body are ceramic.

11. The candle holder apparatus according to claim 7 wherein said cover further comprises an inner lip, wherein edges of said dome shaped heat deflecting shield are held in place inside said recess by said inner lip.

12. The candle holder apparatus according to claim 7 wherein said dome shaped heat deflecting shield directs air from inside said cavity to exit through said at least one vent opening.

13. A method for circulating air within a candle holder comprising a cover and insulating the cover comprising the steps of:

placing a candle in a body having an open top, at least one body wall, and a cavity configured to house the candle;

inserting and retaining a dome shaped heat deflecting shield into a recess at an inner lip of the cover such that the dome shaped heat deflecting shield extends downward such that an air gap is formed between the dome the dome shaped heat deflecting shield and an inner surface of the cover, wherein the air gap insulates and decreases top surface temperatures of the cover;

attaching the cover to the body;

disposing at least one vent opening in the at least one body wall of the body to allow airflow between the cavity and the exterior of the body;

deflecting heat outwards and insulating the cover using the dome shaped heat deflecting shield; and directing air from inside the cavity to exit through the at least one vent opening using the dome shaped heat deflecting shield.

14. The method according to claim 13 wherein said heat deflecting shield is aluminum.

15. The method according to claim 13 wherein said cover and said body are ceramic.

16. The method according to claim 13 wherein said cover further comprises an inner lip.

17. The method according to claim 16 wherein edges of said heat deflecting shield are held in place inside said recess by said inner lip.

18. The method according to claim 13 wherein said dome shape of said heat deflecting shield forces heat to spread outward through the venting holes in said at least one body wall.

* * * * *